US008500404B2

(12) United States Patent
Montgomery et al.

(10) Patent No.: US 8,500,404 B2
(45) Date of Patent: Aug. 6, 2013

(54) PLASMA ACTUATOR CONTROLLED FILM COOLING

(75) Inventors: Matthew D. Montgomery, Jupiter, FL (US); Chander Prakash, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 634 days.

(21) Appl. No.: 12/770,932

(22) Filed: Apr. 30, 2010

(65) Prior Publication Data

US 2011/0268556 A1 Nov. 3, 2011

(51) Int. Cl.
*F01D 5/18* (2006.01)

(52) U.S. Cl.
USPC ..... 416/97 R; 415/115; 415/914; 416/241 R

(58) Field of Classification Search
USPC ..... 415/115, 914; 416/1, 97 R, 241 R
See application file for complete search history.

(56) References Cited

U.S. PATENT DOCUMENTS

| | | | | |
|---|---|---|---|---|
| 6,027,306 | A | 2/2000 | Bunker | |
| 6,419,446 | B1 | 7/2002 | Kvasnak et al. | |
| 6,976,824 | B2 | 12/2005 | Nottin | |
| 6,984,100 | B2 | 1/2006 | Bunker et al. | |
| 7,091,481 | B2 * | 8/2006 | Miller et al. | 250/288 |
| 7,134,842 | B2 | 11/2006 | Tam et al. | |
| 7,183,515 | B2 | 2/2007 | Miller et al. | |
| 7,255,062 | B1 | 8/2007 | Higman | |
| 7,304,396 | B2 | 12/2007 | Haje et al. | |
| 7,351,035 | B2 | 4/2008 | Deschamps et al. | |
| 7,380,756 | B1 | 6/2008 | Enloe et al. | |
| 7,410,532 | B2 | 8/2008 | Krichtafovitch et al. | |
| 7,494,319 | B1 | 2/2009 | Liang | |
| 7,588,413 | B2 | 9/2009 | Lee et al. | |
| 2006/0005545 | A1 | 1/2006 | Samimy et al. | |
| 2007/0258810 | A1 | 11/2007 | Aotsuka et al. | |
| 2008/0067283 | A1 | 3/2008 | Thomas | |
| 2008/0089775 | A1 | 4/2008 | Lee et al. | |
| 2008/0101913 | A1 | 5/2008 | Lee et al. | |
| 2008/0128266 | A1 | 6/2008 | Lee et al. | |

(Continued)

FOREIGN PATENT DOCUMENTS

WO 2009079470 A2 6/2009

OTHER PUBLICATIONS

Roy Subrata and Chin-Cheng Wang; "Plasma actuated heat transfer"; Applied Physics Letters, vol. 92, No. 23; Jun. 12, 2008; pp. 231501-1-to 231501-3; American Institute of Physics; XP012107422.

(Continued)

*Primary Examiner* — Edward Look
*Assistant Examiner* — Liam McDowell

(57) ABSTRACT

A film cooling apparatus with a cooling hole (46) in a component wall (40). A first surface (42) of the wall is subject to a hot gas flow (48). A second surface (44) receives a coolant gas (50). The coolant flows through the hole, then downstream over the first surface (42). One or more pairs of cooperating electrodes (60-61, 62-63, 80-81) generates and accelerates a plasma (70) that creates a body force acceleration (71, 82) in the coolant flow that urges the coolant flow to turn around the entry edge (57) and/or the exit edge (58) of the cooling hole without separating from the adjacent surface (47, 42). The electrodes may have a geometry that spreads the coolant into a fan shape over the hot surface (42) of the component wall (40).

19 Claims, 5 Drawing Sheets

U.S. PATENT DOCUMENTS

| | | | | |
|---|---|---|---|---|
| 2008/0131265 | A1 | 6/2008 | Lee et al. | |
| 2008/0145210 | A1 | 6/2008 | Lee et al. | |
| 2008/0145233 | A1 | 6/2008 | Lee et al. | |
| 2008/0149205 | A1 | 6/2008 | Gupta et al. | |
| 2009/0108759 | A1 | 4/2009 | Tao et al. | |
| 2009/0169356 | A1 | 7/2009 | Wadia et al. | |
| 2009/0169363 | A1 | 7/2009 | Wadia et al. | |
| 2009/0196765 | A1 | 8/2009 | Dyer et al. | |
| 2011/0048025 | A1 * | 3/2011 | Ginn et al. | 60/770 |

OTHER PUBLICATIONS

J. Reece Roth, Xin Dai, Jozef Rahel, and Daniel M. Sherman; "The Physics and Phenomenology of Paraelectric One Atmosphere Uniform Glow Discharge Plasma Actuators for Aerodynamic Flow Control"; AIAA 2005-0781; Presented at the AIAA 43rd Aerospace Sciences Meeting and Exhibit, Reno Hilton Hotel, Reno, Nevada; Jan. 10-13, 2005.

Julia Stephens, Thomas Corke, and Scott Morris; "Turbine Blade Tip Leakage Flow Control": Thick/Thin Blade Effects; AIAA 2007-0646; Presented at the AIAA 45th Aerospace Sciences Meeting and Exhibit, Reno, Nevada, Jan. 8-11, 2007.

Robert C. Nelson, Thomas C. Corke, Chuan He Hesham Othman and Takashi Matsuno; "Modification of the Flow Stucture of a UAV Wing for Roll Control"; AIAA 2007-0884; Presented at the AIAA 45th Aerospace Sciences Meeting and Exhibit, Reno, Nevada, Jan. 8-11, 2007.

Chuan He and Thomas C. Corke; "Numerical and Experimental Analysis of Plasma Flow Control Over a Hump Model"; AIAA 2007-0935; Presented at the AIAA 45th Aerospace Sciences Meeting and Exhibit, Reno, Nevada, Jan. 8-11, 2007.

R. J. Goldstein, E. R. G. Eckert, and F. Burggraf; "Effects of Hole Geometry and Density on Three Dimensional Film Cooling"; International Journal of Heat and Mass Transfer; vol. 17, No. 5, 1974.

Eric Moreau; "Airflow Control by Non-thermal Plasma Actuators"; Journal of Applied Physics D: Applied Physics 40, 2007, pp. 605-636.

D. V. Roupassow, A. A. Nikipelov, M. M. Nudnova, and A. Yu. Starikovsii; "Flow Separation Control by Plasma Actuator with Nanosecond Pulsed Periodic Discharge"; AIAA Journal vol. 47, No. 1, Jan. 2009.

Julia Stephens; "Tip Gap Flow Control of A Pak-B Turbine Blade"; American Physical Society, 58th Annual Meeting of the Division of Fluid Dynamics, Nov. 20-22, 2005.

Chin_Ching Wang and Roy Subrata; "Electrodynamic Enhancement of Film Cooling of Turbine Blades"; Journal of Applied Physics, vol. 104, Issue 7, 2008, pp. 073305-073305-10.

Nikhil M. Rao, Baris Gumusel, Levent Kavurmacioglu, Cengiz Camci; "Influence of Casing Roughness on the Aerodynamic Structure of Tip Vortices in an Axial Flow Turbine"; GT2006-91011; Proceedings of GT2006 ASME Turbo Expo 2006: Power for Land, Sea, and Air; Barcelona, Spain, May 8-11, 2006.

* cited by examiner

FIG 6
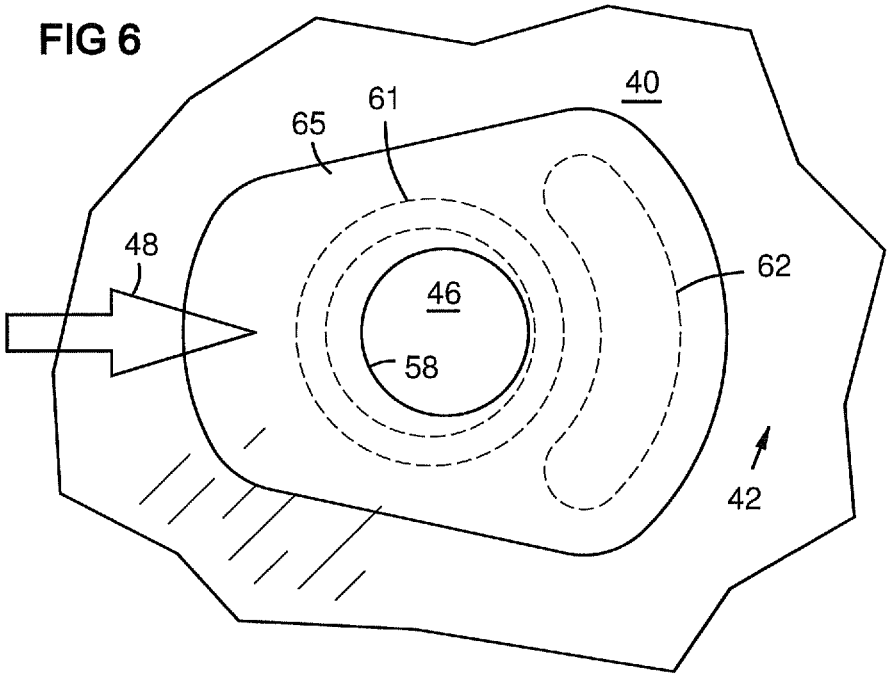
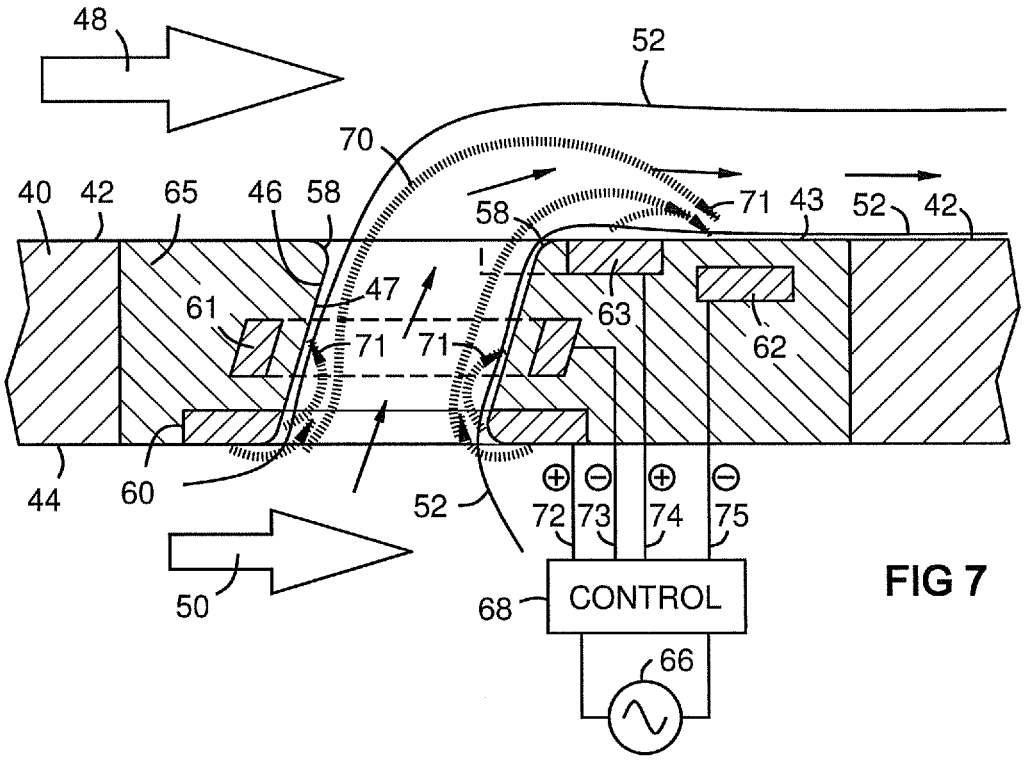
FIG 7

FIG 8
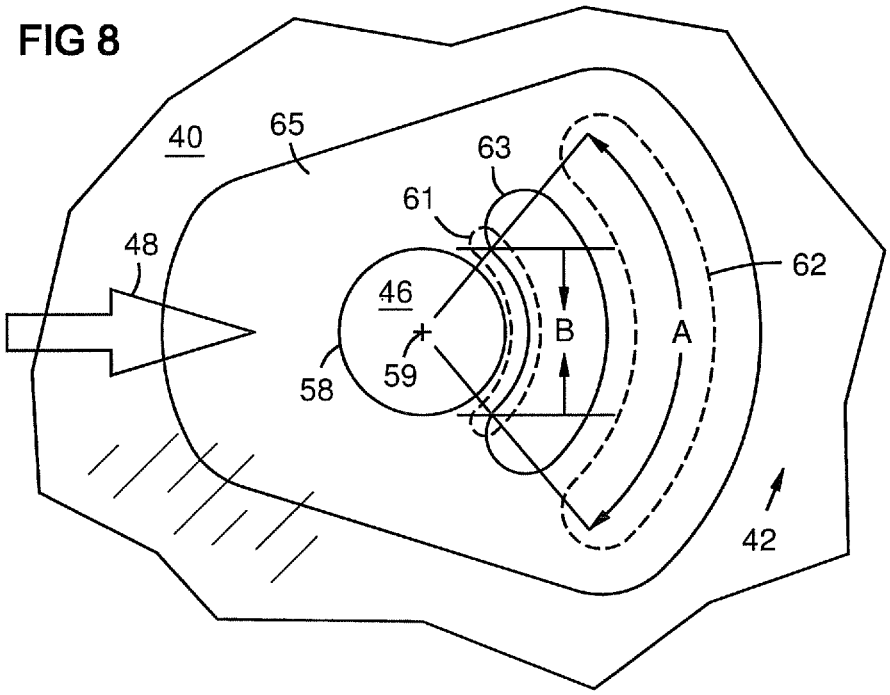
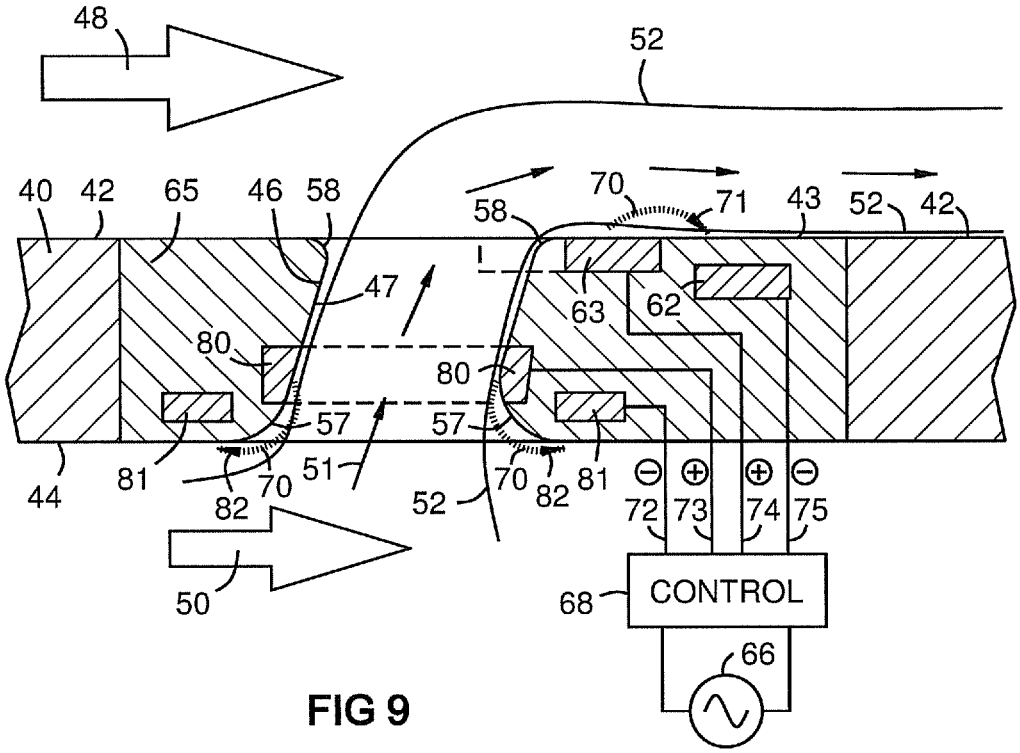
FIG 9

PLASMA ACTUATOR CONTROLLED FILM COOLING

FIELD OF THE INVENTION

The invention relates to plasma-induced flow control of film cooling flows by plasma actuators.

BACKGROUND OF THE INVENTION

Film cooling is a method of cooling a surface by maintaining a thin layer of cooling fluid adjacent to the surface, which separates a hot gas flow from the surface. Gas turbine engines use film cooling on components such as combustors, turbine shrouds, and turbine vanes and blades. Such components have walls with a first surface in a hot gas flow path and an opposite second surface not exposed to the hot gas. A cooling fluid such as air is supplied to the second surface at a pressure greater than the hot gas. Holes in the component walls cause the cooling fluid to pass through the holes to the first surface, and spread over it generally along streamlines of the hot gas flow. This forms a cool boundary layer or "film" on the first surface.

Optimizing the effectiveness of cooling film has been a long-standing concern in gas turbine design. The more evenly the film spreads over the heated surface, and the closer it can be kept to the surface, the more efficient and effective it is.

Dielectric barrier plasma generators have been used to control gas flows in boundary layers for various reasons. Such generators induce a directed flow in a neutral gas via momentum transfer from plasma moving between an exposed electrode and an insulated electrode. US patent publication 2008/0131265 describes modifying a film cooling flow downstream of film cooling holes using plasma generators. The present inventors devised improvements to this technique as described herein.

BRIEF DESCRIPTION OF THE DRAWINGS

The invention is explained in the following description in view of the drawings that show:

FIG. 6 shows a top view of another alternative embodiment of an apparatus as in FIG. 3 that provides a fan-shaped geometry to the cooling film envelope.

FIG. 7 shows a sectional view of an embodiment with an additional exposed electrode.

FIG. 8 shows a top view of a fan-shaped exemplary geometry of the embodiment of FIG. 7.

FIG. 9 shows a sectional view of an embodiment that creates a localized deceleration in the coolant flow around the entry edge of a film cooling hole.

DETAILED DESCRIPTION OF THE INVENTION

The inventors recognized that film cooling can be improved by creating a body force in the coolant gas that urges the coolant flow to turn tightly around the inlet edge and/or outlet edge of the hole, thus reducing separation of the coolant flow from the inside surface of the film cooling hole and/or from the hot surface of the component wall. This can be done by generating a directed plasma around at least a portion of the inlet edge and/or the outlet edge of the film cooling hole using a plasma electrode inside the hole cooperating with an electrode outside it. Exemplary devices are described herein that control a coolant gas flow around the inlet and/or outlet edges of a film cooling hole in a component wall.

Figure 1:
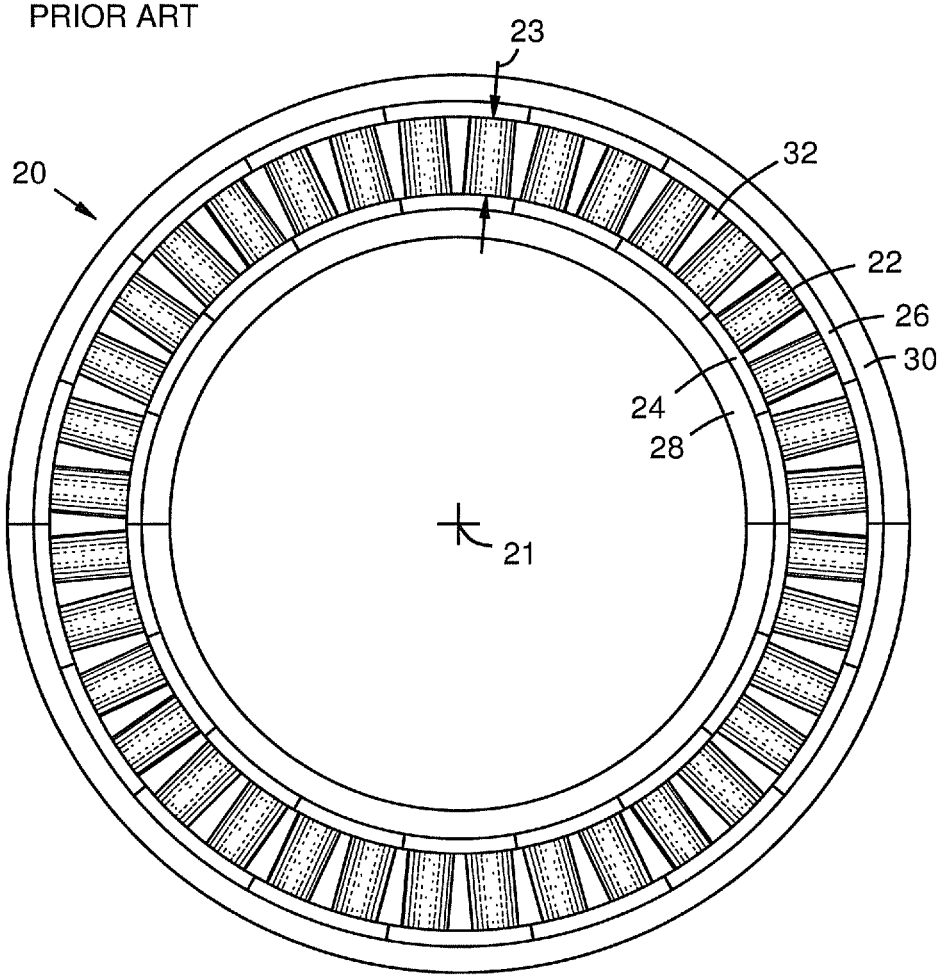
FIG 1 PRIOR ART
FIG. 1 shows a circular array of vanes in a turbine or compressor.

FIG. 1 illustrates a ring 20 of stationary vanes 22 centered on an axis 21 in a gas turbine. Each vane is an airfoil that spans radially 23 between inner and outer platforms 24, 26. Herein "radially" means with respect to the axis 21. The circular arrays of adjacent platforms 24, 26 form inner and outer annular shrouds, between which the combustion gas flow is contained. The platforms may be attached to respective inner and outer ring structures 28, 30, which may be support rings and/or cooling plenums. Between each pair of vanes 22 is a hot gas flow passage 32. The vanes 22 direct the combustion gas flow against an adjacent downstream ring of rotating blades, not shown. It is common to assemble or fabricate two or more vanes 22 per pair of platforms 24, 26 to form what is called a nozzle.

Turbine vanes often have central chambers that receive cooling air from the radially outer plenum 30 and/or inner plenum 28. The outer walls of the vanes may be perforated with film cooling holes, allowing some or all of the cooling air to escape and spread over the outer surfaces of the vanes to provide film cooling. Similarly, the inner and/or outer platforms 24, 26 may have film cooling holes. Such technology is well known, and is not detailed here.

Figure 2:
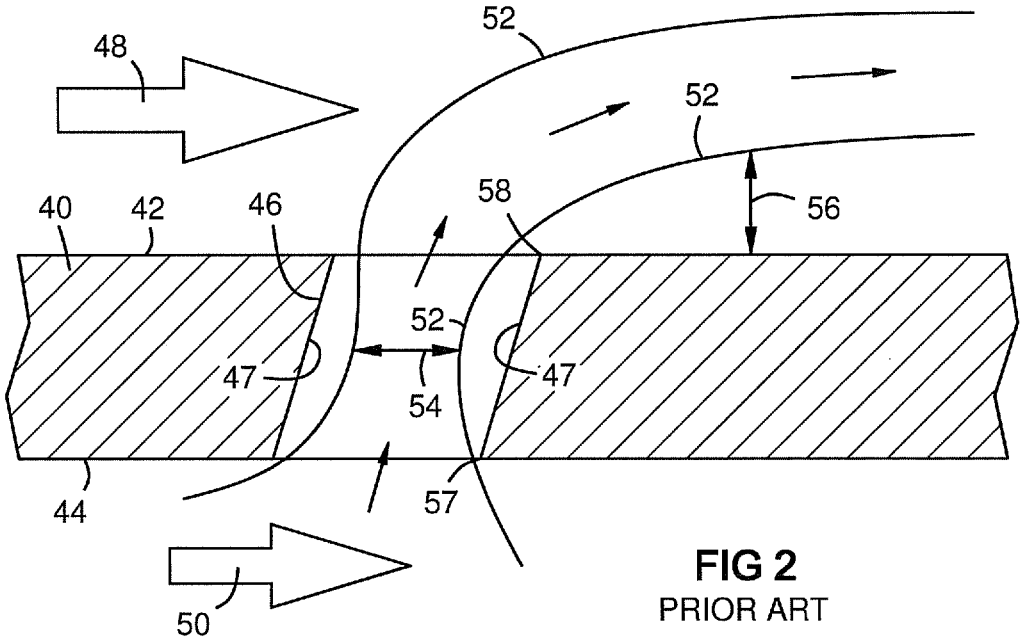
FIG 2 PRIOR ART
FIG. 2 shows a sectional view of a prior art film cooling hole in a component wall.

FIG. 2 shows a film cooling hole 46 in a component wall 40 with a hot gas flow 48 over a heated surface 42. A coolant gas 50 flows over a cooled surface 44. The coolant gas 50 has higher pressure than the hot gas 48, and thus passes through the cooling hole 46 to provide film cooling of the heated surface 42. The coolant gas passing through the hole defines a coolant envelope 52 with a narrowing called a "vena contracta" that occurs whenever a fluid passes through an orifice—in this case, the orifice defined by the coolant entry edge 57 of the hole 46. The coolant envelope 52 overshoots the heated surface 42, and separates from it. These are undesirable conditions for effective film cooling. The vena contracta 54 contributes to the overshoot 56, because it separates the envelope 52 from the inside surface 47 of the hole 46, and thus angles it away from the heated surface 42. The inventors have realized it would be beneficial to force the cooling envelope 52 to closely follow or hug the inside surface 47 of the hole 46 and to hug the exit edge 58 on the downstream side. At both the entry edge 57 and the exit edge 58 of the hole, the coolant envelope 52 shows a gradual turn radius that separates the coolant flow from the respective adjacent surface 47 or 42.

Figure 3:
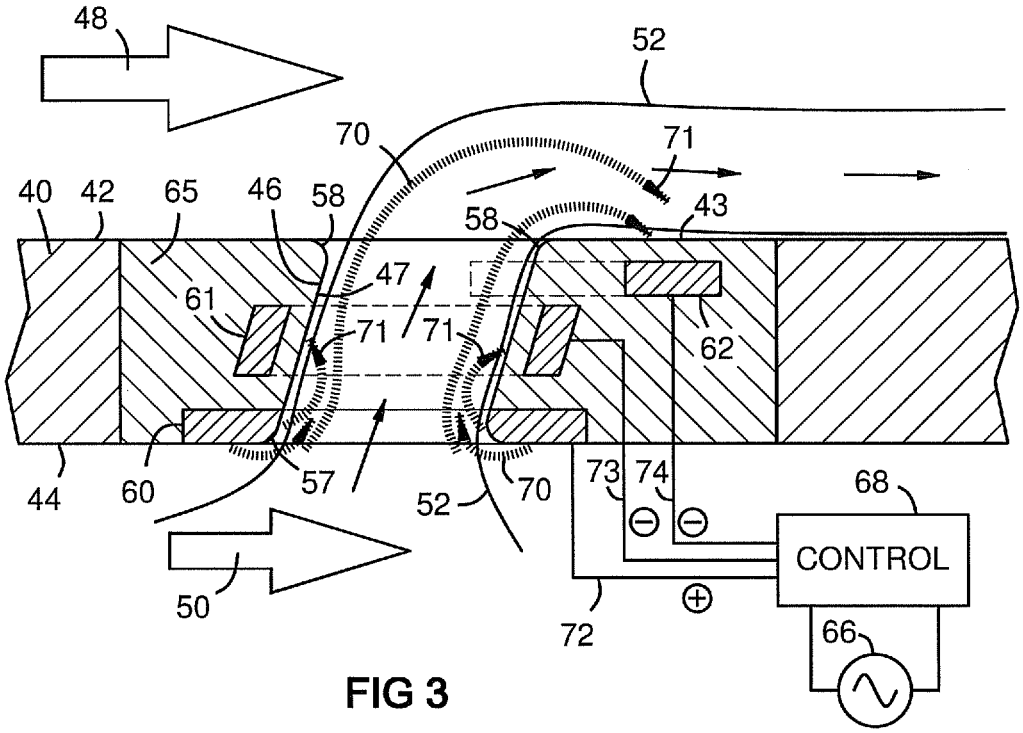
FIG. 3 shows a sectional view of a film cooling apparatus according to aspects of the invention.

FIG. 3 shows an embodiment of the invention that accomplishes this goal. A first exposed electrode 60 and second and third insulated electrodes 61, 62 are mounted in a dielectric material 65. An exemplary geometry of the dielectric material 65 is illustrated, but one skilled in the art will appreciate that only localized regions of dielectric material may be used around each electrode in order to provide a desired degree of electrical insulation for the electrodes. The electrodes are powered by a power supply 66 via a controller 68 to produce a plasma 70 that induces body force accelerations 71 in the coolant that pull the envelope 52 against the inside surface 47 of the hole 46 and against the heated surface 42. The indications of "+" and "−" on the control lines 72 are not intended as limiting, but indicate that the first electrode 60 has an opposite polarity relative to the second and third electrodes 61 and 62 at a given time. The current may be alternating, pulsed, or direct, as known in the art of dielectric barrier plasma-induced gas flows.

The insulated electrodes 61 and 62 may or may not receive the same power parameters as each other. If they use the same parameters, a single control line 73 may supply both electrodes 61, 62. Alternately, separate control lines 73, 74 as shown may supply electrode 61 with a different voltage than electrode 63, for example a higher voltage may be provided to electrode 62 than electrode 61, and/or these electrodes may be powered with different periodic voltage cycles.

For example, electrode 61 may cycle on and off, or may alternate in polarity. In the "on" cycle, it generates plasma with electrode 60, and attracts the resulting positive ions toward a middle portion of the inside surface 47 of the hole 46. This provides a wall-hugging influence on the coolant envelope 52. In the "off" cycle of electrode 61, the positive ions are released, and continue downstream to be attracted by electrode 62. Alternately, instead of an "off" cycle, a positive polarity cycle of lower amplitude and/or duration than the negative cycle may be provided to electrode 61 to expel the positive ions a short distance from the dielectric surface.

Cycle frequencies, voltages, and duration parameters for the electrodes can be calculated from studies of plasma generators in the literature, such that when the ions reach the middle portion of the hole, electrode 61 is switched "off" or is cycled to positive polarity. Exemplary literature includes US patent publication 2009/0196765, and U.S. Pat. No. 7,380,756, both of which are incorporated by reference herein. Electrode 60 quickly absorbs the electrons, since they move faster than the positive ions, and since electrode 60 is exposed. This leaves the positive ions stranded to continue flowing downstream until influenced by electrode 62. Electric power control circuits that provide specified voltage amplitudes and waveforms are known, and are not detailed here.

In the embodiment of FIG. 3 the same ions serve double duty—first, they move the coolant envelope 52 toward the inside surface 47 of the hole 46; and second, they move the envelope to the hot surface 42. The third electrode 62 may cycle on/off or alternate in polarity similarly to electrode 61 in order to avoid a build-up of ions on the dielectric surface 43 that inhibits further attraction.

Figure 4:
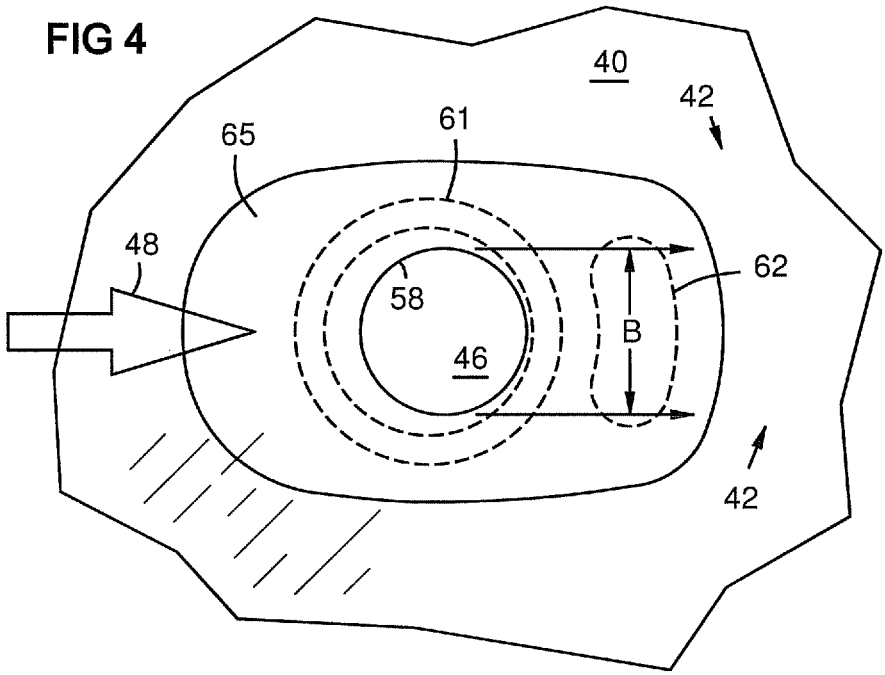
FIG. 4 shows an exemplary top view of an apparatus as in FIG. 3.

FIG. 4 shows an exemplary top view of FIG. 3 in which the second electrode 61 completely encircles the hole 46. This expands the vena contracta portion of the coolant envelope 52 to hug all sides of the inside surface 47 of the hole. The first electrode 60 is not shown for clarity, but it may also encircle the hole in this embodiment. The third electrode 62 is shown spanning a directly downstream area from the hole 46.

Figure 5:
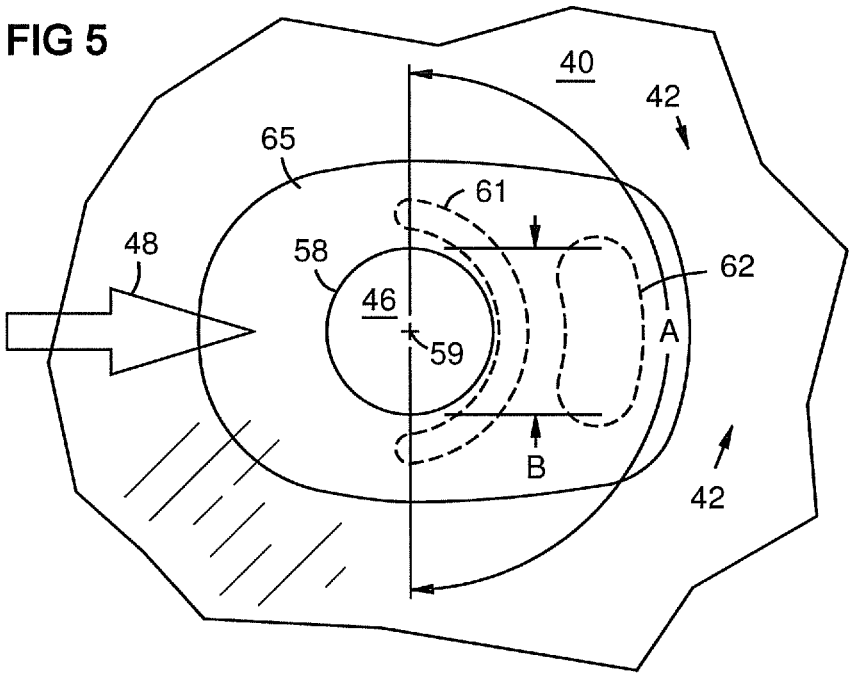
FIG. 5 shows a top view of alternative embodiment of an apparatus as in FIG. 3.

FIG. 5 shows a top view an embodiment in which the second electrode 61 only surrounds a downstream angular portion A of the hole 46. This causes the coolant envelope 52 to hug only the downstream side of the inside surface 47 of the hole. The first electrode 60 in this embodiment is not shown for clarity, but it may cover the same downstream angle A as the second electrode 61, which is about 180 degrees in this example. Suggested downstream angular coverage for the first and second electrodes in this embodiment ranges from about 90 to 180 degrees.

A "downstream angle" may be defined as an angle centered on the geometric center 59 of the exit edge 58 of the hole 46, and facing downstream from said center. This definition does not limit an electrode to any particular shape, such as the shown arcuate shape. An electrode may be any shape while still spanning a given downstream angle. A "directly downstream area" may be defined as a downstream projection of the exit edge 58 of the hole, as shown by boundaries B. All electrodes may at least cover the downstream area B.

FIG. 6 shows a top view of an embodiment with expanded downstream coverage of the third electrode 62. This electrode geometry spreads the coolant envelope 52 in a fan shape over the surface 42. This can work in conjunction with a cylindrical hole as shown or other shapes such as a fan-shaped hole not shown. The illustrated electrode covers an exemplary 90-degree downstream angle. A suggested angular span for such fan-shaped coverage of electrode 62 is about 70 to 120 degrees.

FIG. 7 shows an embodiment with an additional exposed electrode 63 surrounding a downstream portion of the hole edge 58. This electrode 63 generates plasma in conjunction with insulated electrode 62. The insulated electrode 62 attracts both the newly generate ions from electrode 63 and those previously generated and abandoned by electrodes 60 and 61. This strengthens the influence on the cooling envelope toward the component wall surface 42. Independent control lines 72, 73, 74, 75 may be provided for each respective electrode 60, 61, 62, 63.

FIG. 8 shows an exemplary top view of the embodiment of FIG. 7. For clarity, the first exposed electrode 60 is not shown. This embodiment can have similar span options for the electrode geometry as those shown previously. The electrodes 60 and 61 may either encircle the hole 46 or may only surround a downstream portion. The electrodes 62 and 63 may span only a directly downstream area B or a fan-shaped area A, as previously illustrated. In FIG. 8, the exemplary angle A shown is substantially 100 degrees. A suggested angular span for electrode 62 in such a fan-shaped geometry is about 70 to 120 degrees. Electrode 63 may have a similar span angle in this embodiment. In addition, all electrodes should at least span the directly downstream area B. The electrodes may or may not have the same angular coverage as each other. For example, electrodes 60 and 61 might cover 140 degrees while electrodes 62 and 63 cover 100 degrees.

FIG. 9 shows an embodiment that generates a body force acceleration 82 acting in a direction opposite to the coolant flow 51 entering the hole 46. This produces a localized deceleration in the coolant flow 51 around an entry edge of hole 46. This locally reduces momentum in the coolant that would otherwise cause it to overshoot the edge 57 and cause a vena contracta. Thus the coolant envelope 52 is urged by the plasma to make a tighter turn around the entry edge 57 producing a reduced radius of the coolant envelope 52 around the entry edge 57. The exemplary apparatus shown includes an exposed electrode 80 on the inner surface 47 of the cooling hole 46 just inside the entry edge 57 thereof, and a cooperating insulated electrode 81 just outside the entry edge 57. Voltages to these electrodes may be controlled in patterns as known or previously described herein to produce a plasma flow that locally decelerates 82 the coolant flow 51 around the edge 57 of the hole 46 as shown.

As shown, the exit edge 58 may be configured with electrodes as previously described. Alternately, not shown, the exit edge 58 may be configured similarly to the entry edge 57 of FIG. 9 to induce a localized deceleration around the exit edge 58. In such a configuration, an insulated electrode may be mounted just inside the exit edge 58, and an exposed electrode may be mounted just outside the exit edge 58. Combinations of embodiments are possible. For example electrodes may be provided only around the entry edge 57 or only around the exit edge 58 of the film cooling hole, thus controlling the coolant flow around only one edge of the hole. As another example, the exit edge 58 may be configured to induce a localized deceleration in the coolant flow, plus an additional pair of electrodes 62 and 63 as shown in FIG. 9 may be installed downstream of the exit edge 58.

The dielectric 65 may be made of a refractory ceramic such as $AL_2O_3$ or others known in the art. The electrodes and conductors may be made of a high-temperature electrically conductive material such as iridium, platinum, yttrium, carbon fiber, graphite, tungsten, tungsten carbide, or others, and may be formed and assembled by techniques known in the art.

The term "or" herein, unless otherwise specified means "inclusive or", which is a common meaning of this term, and is the same as "and/or".

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A film cooling apparatus, comprising:

a film cooling hole in a component wall; and means for creating a body force in a coolant gas flow that urges the coolant gas flow to turn around an edge of the film cooling hole without separation of the coolant gas flow from a surface adjacent to the edge of the film cooling hole;

said means comprising a pair of plasma-generating electrodes, wherein one electrode is mounted on or in an inner surface of the film cooling hole, and another electrode is mounted adjacent to and outside the film cooling hole.

2. The film cooling apparatus of claim 1, wherein the body force urges the coolant gas to turn around at least one of:

a) an entry edge of the film cooling hole without separation of the film cooling flow from an inside surface of the film cooling hole; and b) an outlet edge of the film cooling hole without separation of the film cooling flow from an adjacent portion of a hot surface of the component wall.

3. A film cooling apparatus, comprising:

a component wall comprising a first surface that is subject to a flow of a hot gas, and a second surface that is subject to a coolant gas that is cooler than, and at a higher pressure than, the hot gas;

a hole in the component wall between the first and second surfaces thereof, wherein a direction of the hot gas flow defines upstream and downstream directions;

a first exposed electrode at least partly surrounding a coolant entry edge of the hole at the second surface;

a second insulated electrode at least partly surrounding a middle portion of the hole; and conductors that effect an electrical potential between the first and second electrodes effective to produce a plasma therebetween that accelerates a flow of the coolant gas toward an inside surface of the hole;

wherein the plasma induces a body force in the coolant gas that reduces a separation of the coolant gas from the inside surface of the hole.

4. The apparatus of claim 3, wherein:

a dielectric material forms a portion of the component wall, and the hole is formed through the dielectric material;

the first electrode is mounted on the dielectric material around the entry edge of the hole; and the second electrode is embedded in and covered by the dielectric material around the middle portion of the hole.

5. The apparatus of claim 4, wherein the second electrode spans a downstream angle from the hole of 90 to 180 degrees, and at least spans a downstream area of the hole.

6. The apparatus of claim 5, wherein the first electrode spans substantially the same downstream angle as the second electrode.

7. The apparatus of claim 4, further comprising:

a third insulated electrode embedded in and covered by the dielectric material downstream of a coolant exit edge of the hole;

a controller that supplies electrical power to the electrodes effective to generate first positive ions between the first and second electrodes, and to cause the second electrode to attract the first positive ions to the middle portion of the hole then to release them, and to cause the third electrode to subsequently attract the first positive ions toward the first surface of the component wall.

8. The apparatus of claim 7, wherein the controller cycles the second electrode between first and second cycles, the first cycle being a negative voltage that generates the plasma with the first electrode and attracts the first positive ions toward the second electrode, the second cycle being a positive voltage of lower amplitude or duration than the negative voltage.

9. The apparatus of claim 8, further comprising a fourth exposed electrode mounted in the dielectric material between the exit edge of the hole and the third electrode, wherein the controller further controls electrical power to the fourth electrode effective to generate second positive ions between the third and fourth electrodes and to cause the third electrode to attract the first and second positive ions.

10. The apparatus of claim 7, wherein the third electrode spans a downstream angle from the hole of between 70 and 120 degrees.

11. A film cooling apparatus, comprising:

a dielectric portion of a component wall, the dielectric portion comprising a first surface subject to a flow of a hot gas and a second surface subject to a coolant gas that is cooler than, and at a higher pressure than, the hot gas;

a hole in the dielectric portion between the first and second surfaces thereof, wherein a direction of the hot gas flow defines upstream and downstream directions;

a first exposed electrode partly embedded in the dielectric portion and at least partly surrounding a coolant entry edge of the hole at the second surface;

a second insulated electrode embedded in an inside surface of the hole at a middle portion of the hole, the second insulated electrode at least partly surrounding the hole around the middle portion thereof; and conductors that effect an electrical potential between the first and second electrodes effective to produce a plasma therebetween that accelerates a flow of the coolant gas toward the inside surface of the hole at the middle portion thereof wherein the plasma induces a body force in a coolant gas that reduces a separation of the coolant gas flow from the inside surface of the film cooling hole.

12. The apparatus of claim 11, wherein the second electrode covers a downstream angle from the hole of substantially 90 to 180 degrees.

13. The apparatus of claim 12, wherein the first electrode covers substantially the same downstream angle as the second electrode.

14. The apparatus of claim 11, further comprising a controller that cycles the second electrode between first and second cycles, the first cycle being a first negative voltage that generates first positive ions with the first electrode and attracts the first positive ions toward the second electrode, the second cycle being a first positive voltage of lower amplitude or duration than the first negative voltage, the first positive voltage releasing the first positive ions from the inside surface of the hole.

15. The apparatus of claim 14, further comprising:

a third insulated electrode embedded in the first surface of the dielectric portion downstream of a coolant exit edge of the hole;

wherein the controller provides a second negative voltage to the third electrode effective to cause the third electrode to attract the first positive ions toward the first surface of the dielectric portion.

16. The apparatus of claim 15, further comprising a fourth exposed electrode mounted in the dielectric portion between the coolant exit edge of the hole and the third electrode, wherein the controller provides a second positive voltage to the fourth electrode effective to generate second positive ions between the third and fourth electrodes, wherein the second negative voltage is effective to cause the third electrode to attract both the first and second positive ions to the first surface of the dielectric portion of the component wall.

17. The apparatus of claim 16 wherein the controller periodically cycles the third exposed electrode to a third positive voltage that releases the first and second positive ions from the first surface of the dielectric portion.

18. The apparatus of claim 16, wherein the fourth electrode spans a downstream angle from the hole of 70 to 120 degrees.

19. The apparatus of claim 18, wherein the second, third, and fourth electrodes cover substantially the same downstream angle from the hole.

* * * * *